US009086246B2

(12) United States Patent
Bollmann

(10) Patent No.: US 9,086,246 B2
(45) Date of Patent: Jul. 21, 2015

(54) COMBINED LIGHTING AND AIR CONDITIONING FIXTURE

(71) Applicant: Ringdale Inc., Georgetown, TX (US)

(72) Inventor: Klaus Bollmann, Horseshoe Bay, TX (US)

( * ) Notice: Subject to any disclaimer, the term of this patent is extended or adjusted under 35 U.S.C. 154(b) by 376 days.

(21) Appl. No.: 13/651,281

(22) Filed: Oct. 12, 2012

(65) Prior Publication Data

US 2013/0276463 A1 Oct. 24, 2013

Related U.S. Application Data

(60) Provisional application No. 61/546,275, filed on Oct. 12, 2011.

(51) Int. Cl.

| | |
|---|---|
| ***F25B 21/02*** | (2006.01) |
| ***F28F 27/02*** | (2006.01) |
| ***F24F 3/056*** | (2006.01) |
| ***F21V 33/00*** | (2006.01) |
| ***F25B 21/00*** | (2006.01) |
| *F24F 11/00* | (2006.01) |

(52) U.S. Cl.

CPC ..... *F28F 27/02* (2013.01); *F21V 33/0092* (2013.01); *F24F 3/056* (2013.01); *F25B 21/00* (2013.01); *F25B 21/02* (2013.01); *F24F 11/006* (2013.01)

(58) Field of Classification Search

CPC ..... F25B 21/02; F25B 27/00; Y02B 30/66
USPC ..... 62/3.1, 3.2, 238.1, 190, 519
See application file for complete search history.

(56) References Cited

U.S. PATENT DOCUMENTS

| | | | | |
|---|---|---|---|---|
| 4,095,740 | A * | 6/1978 | Wirth | 236/47 |
| 4,824,012 | A * | 4/1989 | Tate | 236/49.3 |
| 4,969,508 | A * | 11/1990 | Tate et al. | 165/209 |
| 5,224,648 | A * | 7/1993 | Simon et al. | 236/51 |
| 5,289,094 | A * | 2/1994 | Young | 318/468 |
| 5,341,988 | A * | 8/1994 | Rein et al. | 236/49.3 |
| 6,241,156 | B1 * | 6/2001 | Kline et al. | 236/49.3 |
| 7,226,497 | B2 * | 6/2007 | Ashworth | 95/70 |
| 7,900,849 | B2 * | 3/2011 | Barton et al. | 236/51 |
| 2005/0156052 | A1 * | 7/2005 | Bartlett et al. | 236/49.3 |
| 2005/0244309 | A1 | 11/2005 | Wang | |
| 2007/0012052 | A1 * | 1/2007 | Butler et al. | 62/181 |

FOREIGN PATENT DOCUMENTS

| | | | |
|---|---|---|---|
| JP | 63123943 | A | 5/1988 |
| JP | 2008116059 | A | 5/2008 |
| JP | 2011145045 | A | 7/2011 |
| WO | 2009087096 | A1 | 7/2009 |

* cited by examiner

*Primary Examiner* — Melvin Jones
(74) *Attorney, Agent, or Firm* — Hulsey Hunt, P.C.

(57) ABSTRACT

The disclosed embodiments describe a cost and energy efficient combined lighting and air conditioning fixture. This combined system may employ a flexible distributed air handler that can employ distributed heat exchangers to a liquid loop. The described system may be comprised of distributed dampers, heat exchangers, and air handlers that are controlled from a controller integrated into a ceiling, floor, or wall unit. The controller may also be part of a combined LED lighting drop-in ceiling fixture.

9 Claims, 9 Drawing Sheets

Top view of fixture showing hot and cold fluid ports.

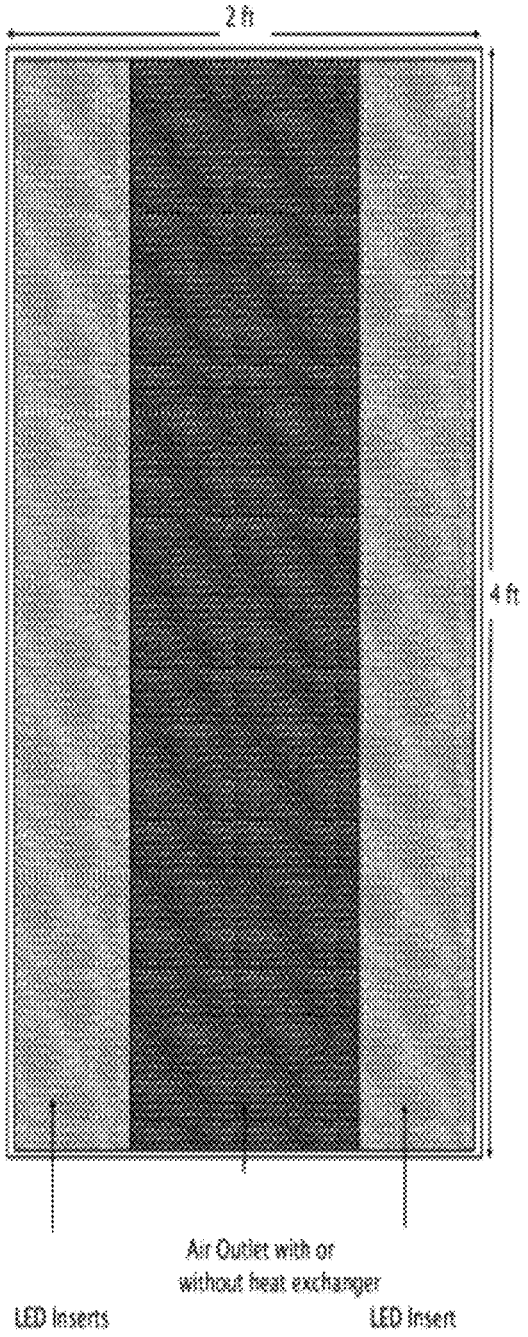
FIGURE 1 is a bottom view of an example fixture showing an air outlet and LED inserts.

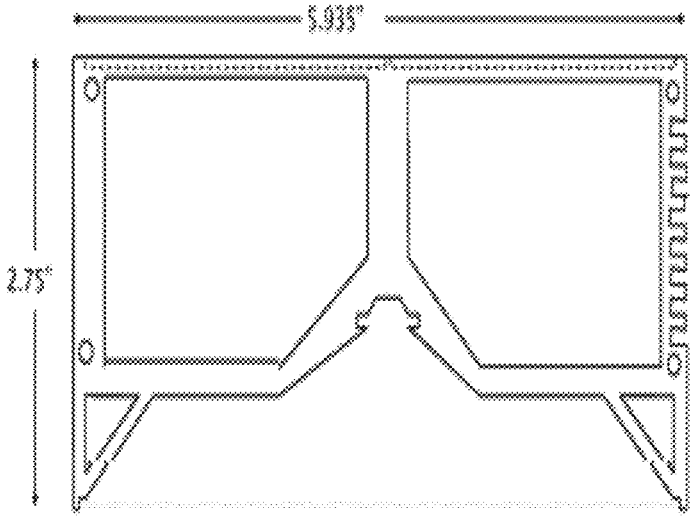
FIGURE 2 is a side view of an example LED insert.

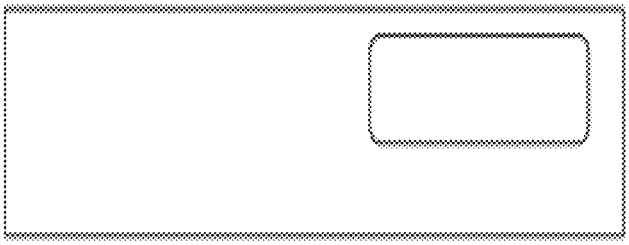
FIGURE 3 Side view of LED Insert in fixture.

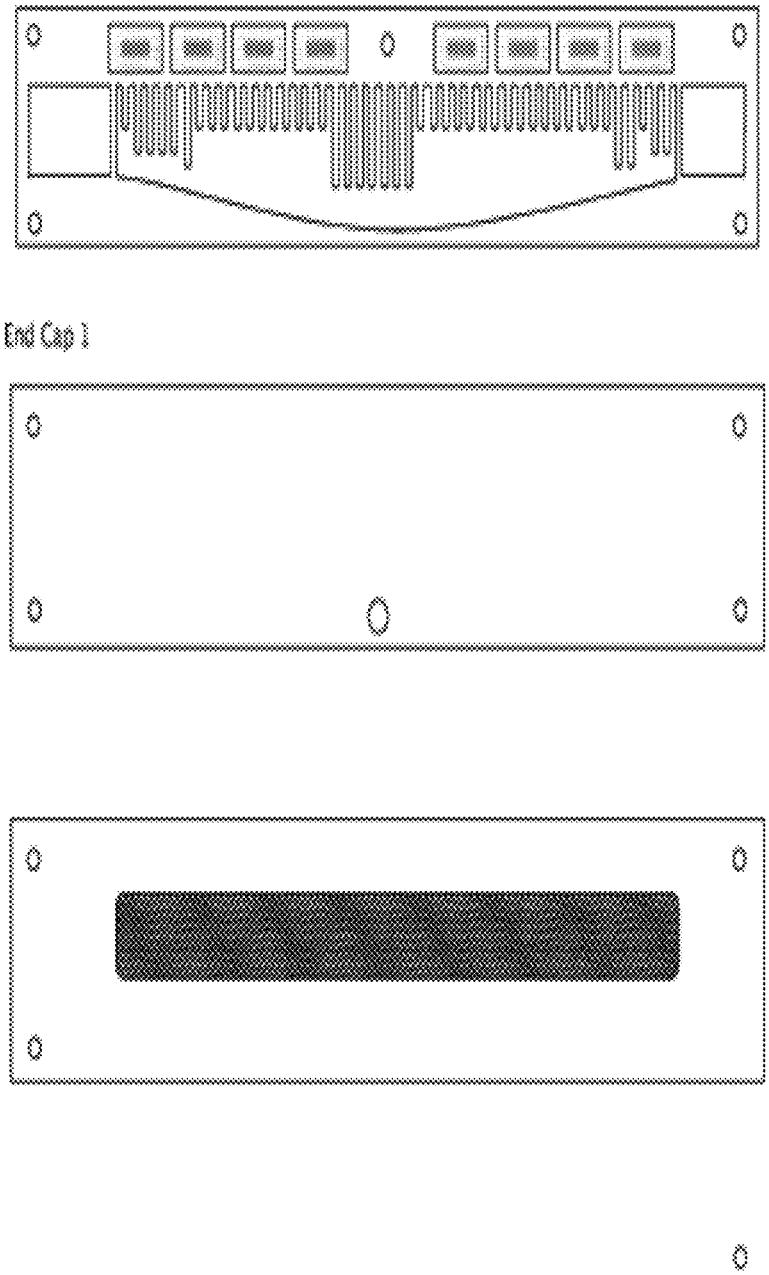
FIGURE 4 Side view of Air Handler and end caps.

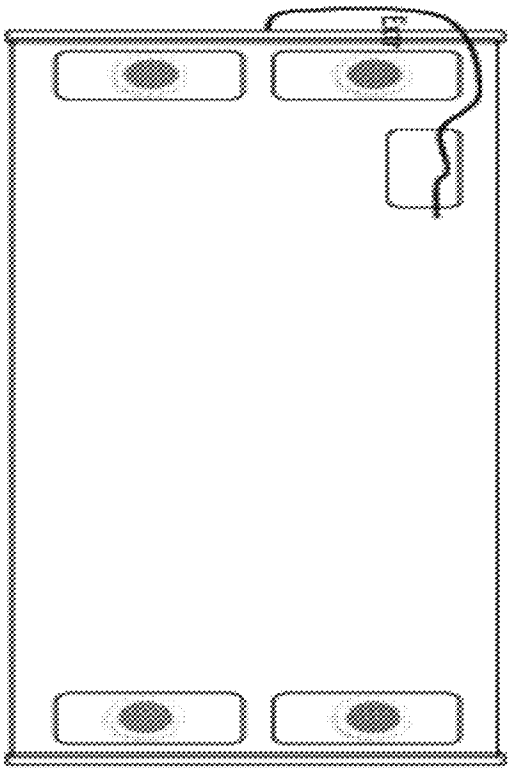
FIGURE 5 Top view of fixture showing hot and cold fluid ports.

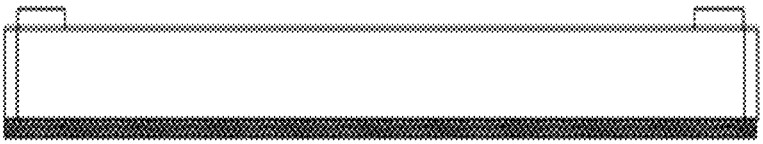
FIGURE 6 side view of fixture.

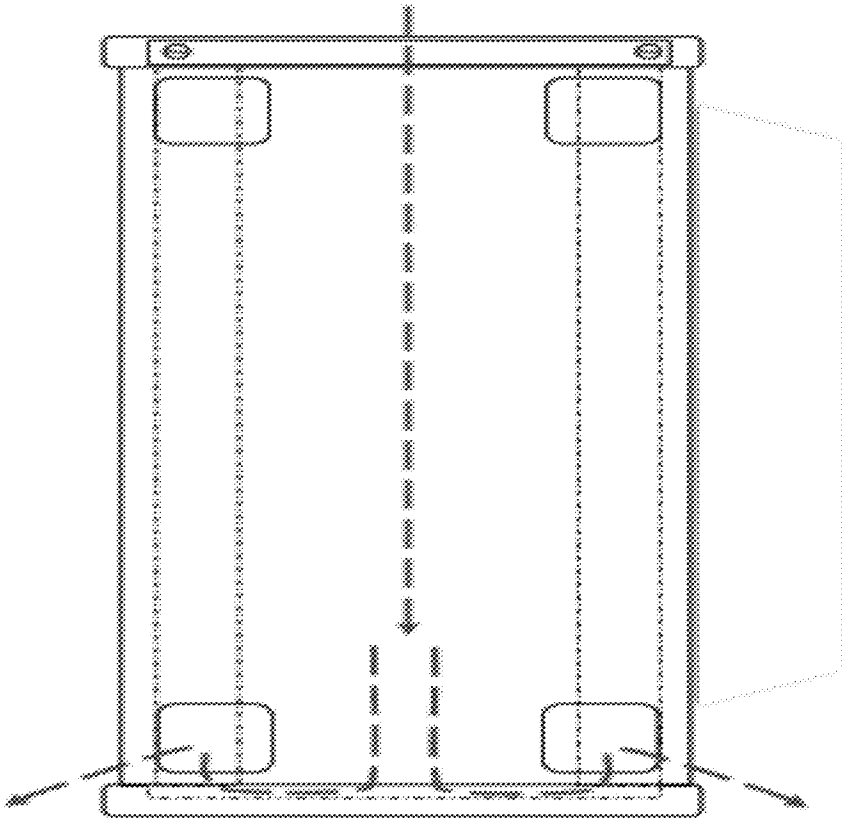
FIGURE 7 bottom view of fixture showing air flow.

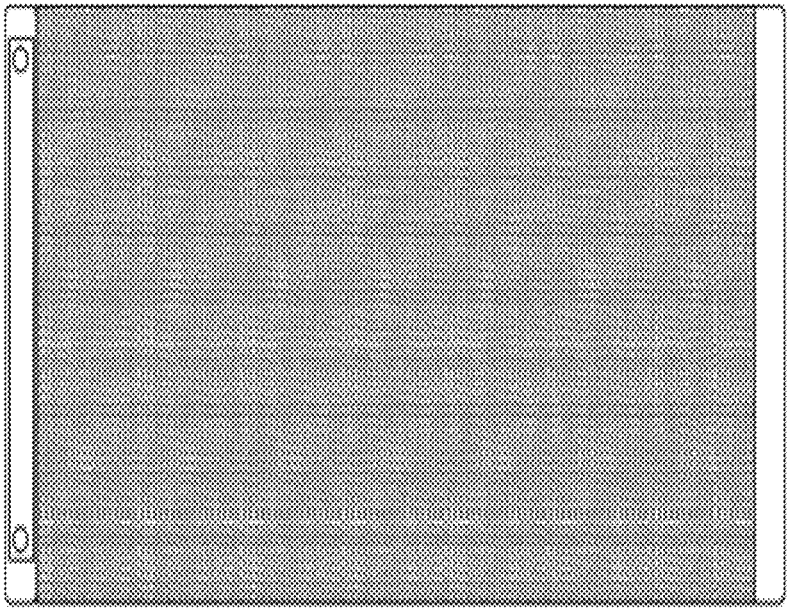
FIGURE 8 bottom view of fixture with grill.

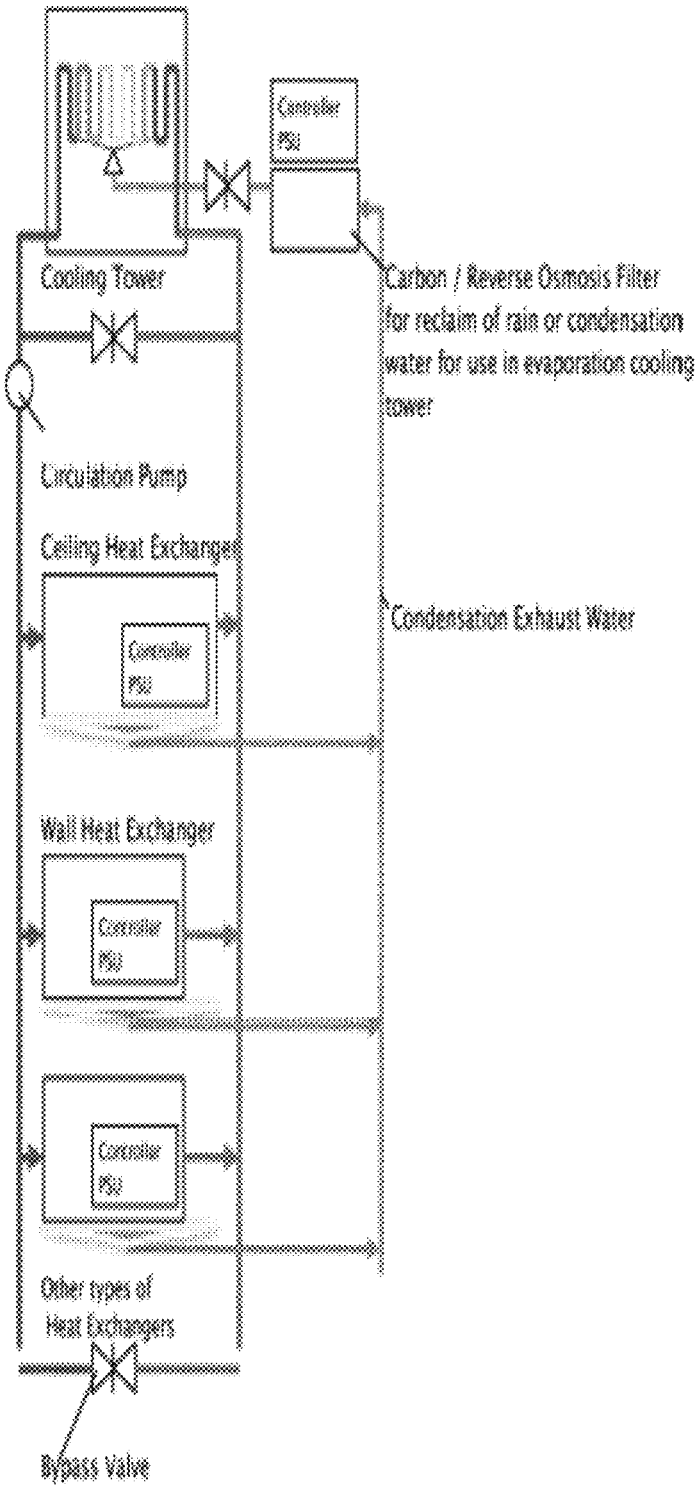
FIGURE 9 system schematic.

COMBINED LIGHTING AND AIR CONDITIONING FIXTURE

RELATED APPLICATIONS

This application claims priority to U.S. Provisional Patent Application Ser. No. 61/546,275, filed Oct. 12, 2011, which is hereby incorporated by reference for all purposes.

BACKGROUND OF THE INVENTION

Conventional technology, such as fluorescent lighting, has been used in combined manner in the industry to communicate with air conditioning systems. LED lights have also been employed, in combination with an air conditioning system, by adding a "chilled or heated air" duct connection to the panel.

There is currently a need for more efficient and environmentally friendly air conditioning systems. These improved systems may be based on water or emulsion loops for the distribution of heated or chilled water.

BRIEF SUMMARY OF THE INVENTION

The embodiments described herein provide for a combined light and air conditioning fixture. This system will be cost efficient to produce, on a large or small scale, and will utilize a flexible distributed air handler than can achieve the best, state of the art interface efficiency at a low cost.

The disclosed invention may utilize distributed heat exchangers to a liquid loop. where only one main liquid loop is required, an evaporation cooling tower technology may be employed, and the simultaneous heating and cooling in a large application can be achieved using a minimal amount of energy.

These and other aspects of the disclosed subject matter, as well as additional novel features, will be apparent from the description provided herein. The intent of this summary is not to be a comprehensive description of the claimed subject matter, but rather to provide a short overview of some of the subject matter's functionality. Other systems, methods, features and advantages here provided will become apparent to one with skill in the art upon examination of the following FIGURES and detailed description.

BRIEF DESCRIPTION OF THE DRAWINGS

The invention itself, as well as a preferred mode of use, further objectives, and advantages thereof, will best be understood by reference to the following detailed description of an illustrative embodiment when read in conjunction with the accompanying drawings, wherein:

FIG. 1 is a bottom view of an example fixture showing an air outlet and LED inserts.

FIG. 2 is a side view of an example LED insert.

FIG. 3 Side view of LED Insert in fixture.

FIG. 4 Side view of Air Handler and end caps.

FIG. 5 Top view of fixture showing hot and cold fluid ports.

FIG. 6 side view of fixture.

FIG. 7 bottom view of fixture showing air flow.

FIG. 8 bottom view of fixture with grill.

FIG. 9 system schematic.

DETAILED DESCRIPTION OF THE INVENTION

The disclosed embodiments describe a cost and energy efficient combined lighting and air conditioning fixture. This system may utilize a flexible distributed air handler that can employ distributed heat exchangers to a liquid loop. The liquid loop may only require a singular loop, employ evaporation cooling tower technology, and simultaneous heating and cooling in a large application can be achieved using a minimal amount of energy.

An exemplary embodiment may be comprised of distributed dampers, heat exchangers, and air handlers that are controlled from a controller integrated into a ceiling, floor, or wall unit. The controller may also be part of a combined LED lighting drop-in ceiling fixture.

In another embodiment, the fixture integrates an Air Handler or Air-Damper with an LED lighting fixture in form of a 2'×2', 2'×4', 60 cm×60 cm, or 60 cm×120 cm drop in ceiling panel.

In yet another embodiment, the combined LED and Air Outlet has a motor driven damper that can shut, partially or fully open an air vent. The motor is driven by the LED driver power supply. The air damper will open or close depending on a thermostat measuring the room temperature by averaging inlet and outlet air temperature.

The heat exchanger of some embodiments will utilize a unique construction of heat or cold transport and an opposite side air interface will be employed. In some embodiments, the heat exchanger may come in the form of an extrusion that in itself has a shape that incorporates appropriate surfaces and structural features to allow integration of heat transport pipes, fans, drip tray and water connections to be easily adapted. The length of the extrusion will determine the BTUs that can be transferred at a certain air to extrusion temperature difference.

This device may be easily mass produced with a high degree of automation using a small amount of natural resources while promising a life time of about 3 to 4 times that of conventional technology, namely state change refrigeration units using Freon, R22, Propane or similar gases.

The device may also be used for cooling and heating by means of electronic control of the solid state heat pump. The unit can combine dehumidifier, drip tray, and condensed water removal via miniature pump.

In some embodiments, algorithms may be employed to protect solid state heat pumps from operating outside safe envelopes will also act to elongate total unit life.

It is not possible to extrude small cavities in Aluminum or Copper, which would be required to increase the surface area the water, emulsion, or other substance would be able to have contact with in order to pass with maximum contact to allow minimizing the number of cavities. The would also limit liquid flow to the minimum as moving the media costs pump energy, thus further reducing the running costs of an air conditioning system.

In some embodiments of the disclosed invention, the cavity is bigger than ideal. The larger cavity is achieved by inserting a plastic or other extruded filler so that the water has to squeeze into the small cavity around it, making perfect contact with the walls of the device for optimal heat transfer from the solid to the medium.

The drip tray, air channels, and fins are all in one extruded unit allowing modularity. By cutting, for example, units in 2',4', or 8' lengths, a 1000, 2000 or 4000 BTU capable air transfer unit can be produced.

The present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teaching herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

The invention claimed is:

1. A combined lighting and air conditioning fixture comprising:

at least one distributed damper, said damper opening and closing depending on a temperature of air in a room;

at least one heat exchanger, said heat exchanger in thermal contact with a fluid and a portion of said air in said room, wherein said heat exchanger either transfers heat from a liquid medium to said air or transfers heat from said air to said liquid medium depending on the difference between a desired temperature of said room and said temperature of air in said room;

an air handler, said air handler forcing said air in said room to contact said heat exchanger;

an LED lighting fixture, wherein said at least one distributed damper, said at least one heat exchanger, said air handler, and said LED lighting fixture are combined such that said combination is capable of replacing a single drop in ceiling panel; and an electronic control device, said electronic control device controlling said at least one distributed damper, said at least one heat exchanger, said air handler, and said LED lighting fixture to adjust or maintain both said temperature of said room and the brightness of said LED lighting fixture.

2. The fixture of claim 1, wherein said distributed damper is open and closed by a motor.

3. The fixture of claim 2, wherein said motor receives power from a LED driver power supply, said LED driver power supply also powering said LED lighting fixture.

4. The fixture of claim 1, wherein said at least one heat exchanger is selected from the group consisting of a Peltier and a Magneto Caloric Element.

5. The fixture of claim 1, having a plurality of the combination of said at least one distributed damper, said at least one heat exchanger, said air handler, and said LED lighting fixture combined such that said combination is capable of replacing a single drop in ceiling panel and said electronic control devices wherein each of said plurality of said combination and said electronic control devices work in cooperation to manage the temperature of each of a plurality of rooms.

6. The fixture of claim 5, wherein said desired temperature in at least one of said plurality of rooms is achieved by the exchange of heat from another one of said plurality of rooms.

7. The fixture of claim 1, the fixture requiring a single liquid loop to carry said liquid medium.

8. The fixture of claim 1, said fixture further comprising an opposite side air interface.

9. The fixture of claim 8, wherein the opposite side air interface is used in conjunction with said at least one heat exchanger.

* * * * *